US009796077B2

(12) United States Patent
Perkins

(10) Patent No.: US 9,796,077 B2
(45) Date of Patent: Oct. 24, 2017

(54) TOOLBOX

(71) Applicant: James Perkins, Sudan, NM (US)

(72) Inventor: James Perkins, Sudan, NM (US)

( * ) Notice: Subject to any disclaimer, the term of this patent is extended or adjusted under 35 U.S.C. 154(b) by 0 days.

(21) Appl. No.: 14/951,486

(22) Filed: Nov. 24, 2015

(65) Prior Publication Data

US 2016/0144502 A1 May 26, 2016

Related U.S. Application Data

(60) Provisional application No. 62/083,388, filed on Nov. 24, 2014.

(51) Int. Cl.

| | |
|---|---|
| ***B65D 85/28*** | (2006.01) |
| ***B25H 3/02*** | (2006.01) |
| ***B25H 3/04*** | (2006.01) |

(52) U.S. Cl.

CPC ..... *B25H 3/028* (2013.01); *B25H 3/023* (2013.01); *B25H 3/04* (2013.01)

(58) Field of Classification Search

CPC ..... B25H 3/02; B25H 3/025; B25H 3/023; B25H 3/04; A47B 96/00; A47B 96/16

USPC ..... 206/349, 372, 373, 374–379; 312/271, 312/270.2, 304, 325, 327, 328, 350

See application file for complete search history.

(56) References Cited

U.S. PATENT DOCUMENTS 5,332,305 A * 7/1994 Slivon ..... B25H 3/028 312/328

* cited by examiner

*Primary Examiner* — J. Gregory Pickett
*Assistant Examiner* — Rafael Ortiz
(74) *Attorney, Agent, or Firm* — Shannon L Warren

(57) ABSTRACT

A toolbox is disclosed. The toolbox comprises a body, a one or more supports and a pivoting rack. The body comprises a lid, a bottom plate, a faceplate, a back plate, a first side, a second side. The toolbox is configured for selectively transitioning between an expanded configuration and a closed configuration. The expanded configuration of the toolbox comprises an expanded height. The body selectively opens and closes between the expanded configuration and the closed configuration. With the toolbox in the closed configuration the body comprises a substantially rectangular shape and encases the tool box with the first side and the second side on it sides, the lid and a bottom plate at its top and bottom, and the faceplate and a back plate at its front and back sides. The lid selectively rotates on a first hinge relative to the back plate. The faceplate selectively rotates on a second hinge relative to the lid rack. with the toolbox in the expanded configuration, the one or more supports a portion of the toolbox. With the toolbox in the closed configuration the faceplate selectively rotates on the second hinge to provide access within the toolbox. A portion of the body wraps around the pivoting rack including the bottom plate which is attached to the back plate, the lid which is rotateably attached to the back plate, and the faceplate which is rotateably attached to the lid.

12 Claims, 11 Drawing Sheets

TOOLBOX

CROSS-REFERENCE TO RELATED APPLICATIONS

This application claims benefit to U.S. Patent Application No. 62/083,388, filed Nov. 24, 2014 which was one year prior to the filing of this application. All rights in the earlier application are claimed and incorporated by reference hereby.

PETITION TO MAKE SPECIAL

Submitted herewith is USPTO form PTO/SB/130 (07-09) establishing the Applicant's entitlement to make this application special based on the age of the Applicant.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to an improved toolbox. Examples of similar disclosures can be found at U.S. Pat. No. 7,510,078 B2. However, none of the known inventions and patents, taken either singularly or in combination, is seen to describe the instant disclosure as claimed. Accordingly, an improved toolbox would be advantageous.

BRIEF SUMMARY OF THE INVENTION

A toolbox is disclosed. The toolbox comprises a body, a one or more supports and a pivoting rack. The body comprises a lid, a bottom plate, a faceplate, a back plate, a first side, a second side. The toolbox is configured for selectively transitioning between an expanded configuration and a closed configuration. The expanded configuration of the toolbox comprises an expanded height. The body selectively opens and closes between the expanded configuration and the closed configuration. With the toolbox in the closed configuration the body comprises a substantially rectangular shape and encases the tool box with the first side and the second side on it sides, the lid and a bottom plate at its top and bottom, and the faceplate and a back plate at its front and back sides. The lid selectively rotates on a first hinge relative to the back plate. The faceplate selectively rotates on a second hinge relative to the lid. With the toolbox in the expanded configuration, the one or more supports a portion of the toolbox. With the toolbox in the closed configuration the faceplate selectively rotates on the second hinge to provide access within the toolbox. A portion of the body wraps around the pivoting rack including the bottom plate which is attached to the back plate, the lid which is rotateably attached to the back plate, and the faceplate which is rotateably attached to the lid.

DETAILED DESCRIPTION OF THE INVENTION

Described herein is an improved toolbox. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
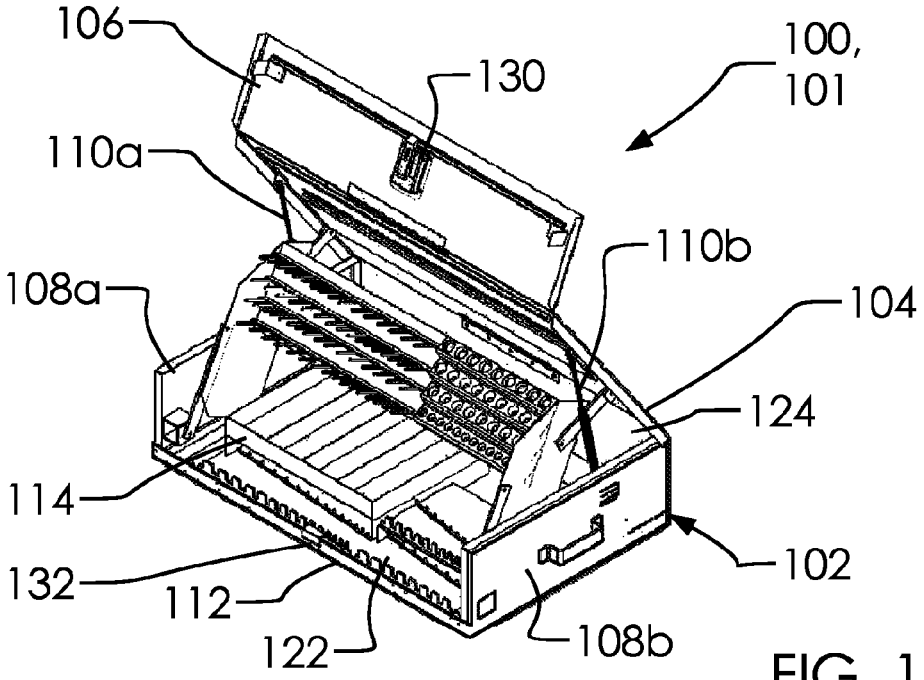
FIGS. 1A and 1B illustrate an elevated first side and second side overview of a toolbox 100 in an expanded configuration 101.
Figure 1B:
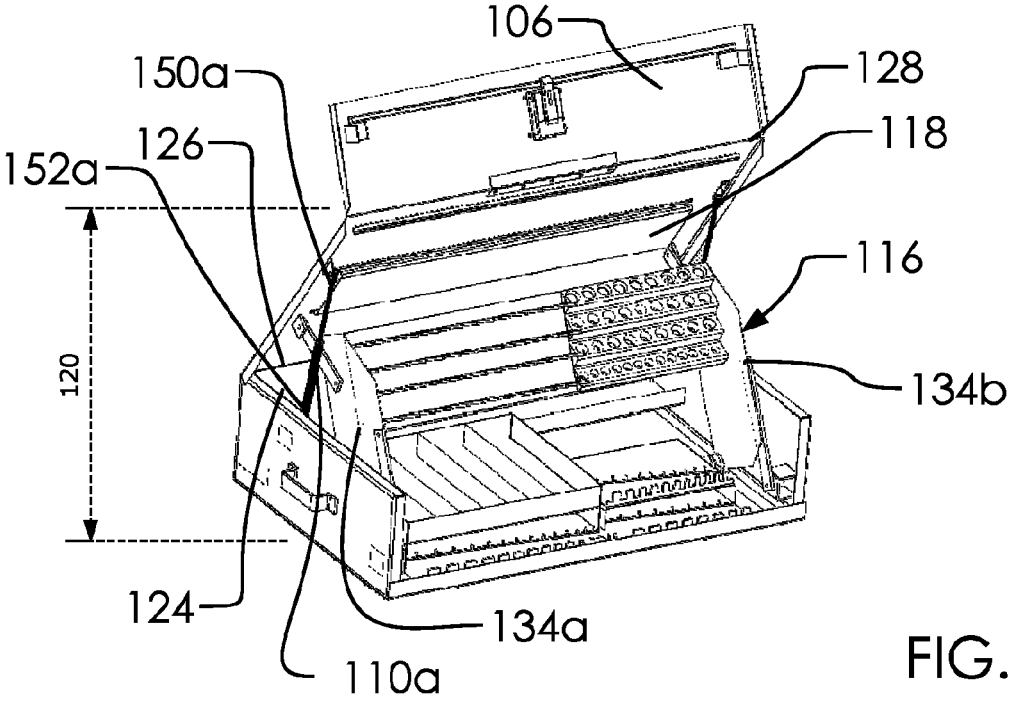

FIGS. 1A and 1B illustrate an elevated first side second side overview of a toolbox 100 in an expanded configuration 101.

In one embodiment, said toolbox 100 can comprise a body 102, a lid 104, a faceplate 106, a sides (which can comprise a first side 108*a* and a second side 108*b*), a one or more supports (which can comprise a first support 110*a* and a second support 110*b*), a lower tray 112, a drawer 114, a pivoting rack 116, and a lid rack 118. In one embodiment, said expanded configuration of said toolbox 100 can comprise an expanded height 120. In one embodiment, said body 102 can encase said toolbox 100 with: said first side 108*a* and said second side 108*b* on it sides; said lid 104 and a bottom plate 122 at its top and bottom; and said faceplate 106 and a back plate 124 at its front and back sides. In one embodiment, said lid 104 rotates on a first hinge 126 relative to said back plate 124; and said faceplate 106 rotates on a second hinge 128 relative to said lid 104. Said pivoting rack 116 comprises a first side 134*a* and a second side 134*b*. In one embodiment, each among said first support 110*a* and said second support 110*b* can comprise a first end (such as a first end 150*a*) and a second end (such as said second end 152*a*). In one embodiment, said first end 150*a* of said first support 110*a* rotateably attaches to said lid 104, and said send end 152*a* of said first support 110*a* rotateably attaches to said first side 108*a*. In one embodiment, said first support 110*a* and said second support 110*b* can comprise a two supports; wherein, said two support selectively hold said lid 104 in said expanded configuration.

In one embodiment, said toolbox 100 can comprise a latching system which can comprise a latch 130 and a strike plate 132; further, said latching system can comprise a locking mechanism as is known in the art.

In one embodiment, said lid 104 and said faceplate 106 can be held up by said first support 110*a* and said second support 110*b*.

Figure 2:
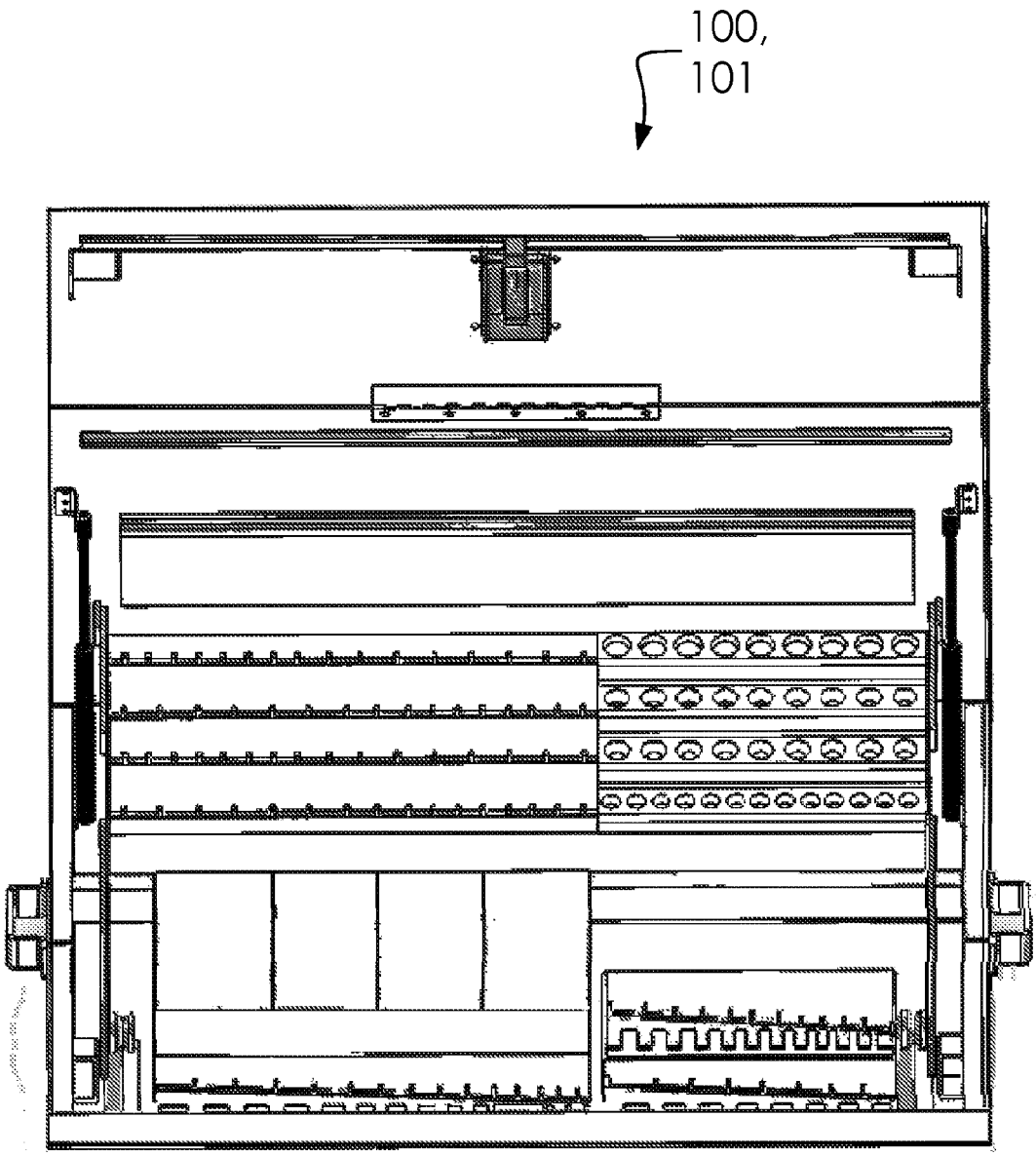
FIG. 2 illustrates an elevated front side view of said toolbox 100 in said expanded configuration 101.

FIG. 2 illustrates an elevated front side view of said toolbox 100 in said expanded configuration 101.

Figure 3:
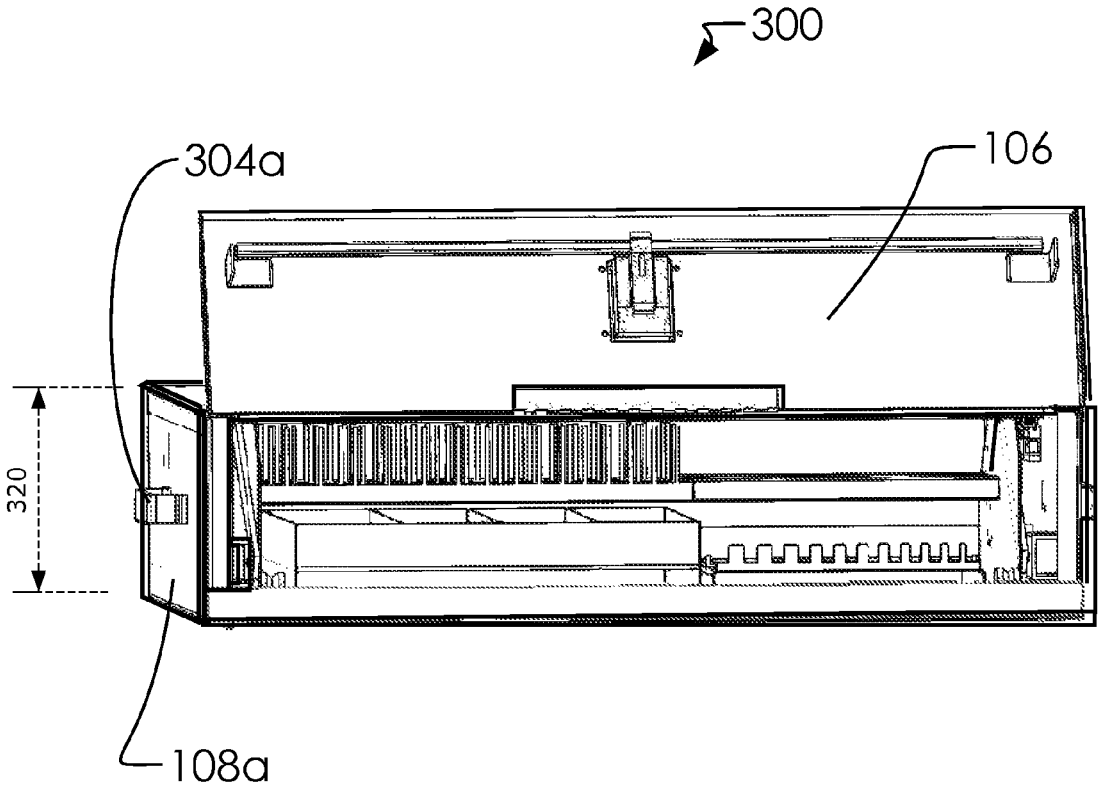
FIG. 3 illustrates an elevated front side view of said toolbox 100 in a closed configuration 300 with said faceplate 106 opened.

FIG. 3 illustrates an elevated front side view of said toolbox 100 in a closed configuration 300 with said faceplate 106 opened.

In one embodiment, said first side 108*a* can comprise a first handle 304*a* on said first side 108*a*, and a second handle 304*b* (not illustrated here) on said second side 108*b*. In one embodiment, said toolbox 100 can comprise a one or more handles (which can comprise said first side 108*a* and said second side 108*b*).

In one embodiment, said collapsed configuration 300 can allow for access to tools within said toolbox 100. For example, in one embodiment, said faceplate 106 can open with said toolbox 100 in said collapsed configuration 300; thereby, said drawer 114 (for example) can be rolled out and accessed with said toolbox 100 in a low profile (that is, said collapsed configuration 300). This feature can be a substantial value add to users of said toolbox 100, because they can stack tools and equipment on top of said toolbox 100 and still access a portion of its contents. Further, said toolbox 100 can be constructed to withstand heavy weights on top of said lid 104. The combination of these features amounts to a more useful tool box than the prior art because it is compact and still accessible, but none the less can fold up and expose a complete tool set when desired.

Figure 4:
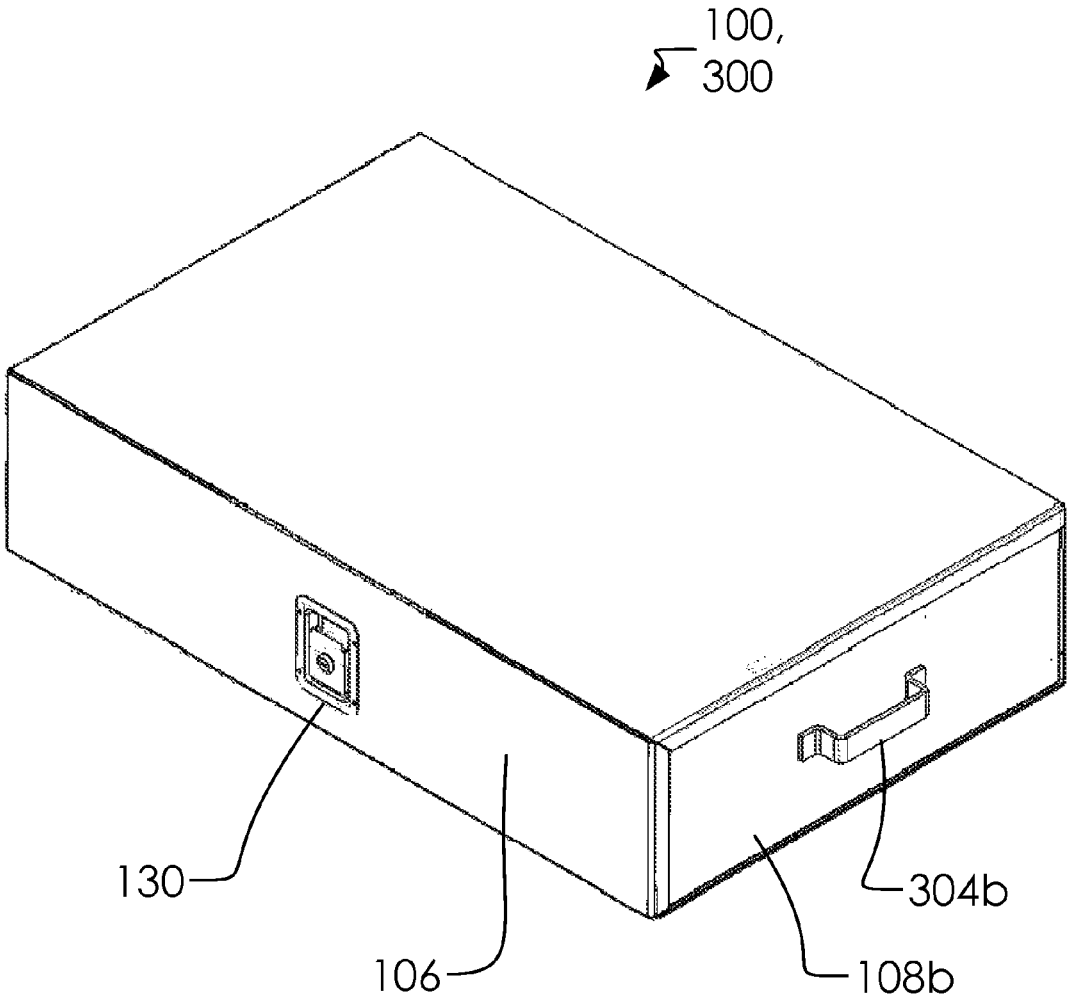
FIG. 4 illustrates an elevated second side overview of said toolbox 100 in a closed configuration 300 with said faceplate 106 closed.

FIG. 4 illustrates an elevated second side overview of said toolbox 100 in a closed configuration 300 with said faceplate 106 closed.

Figure 5:
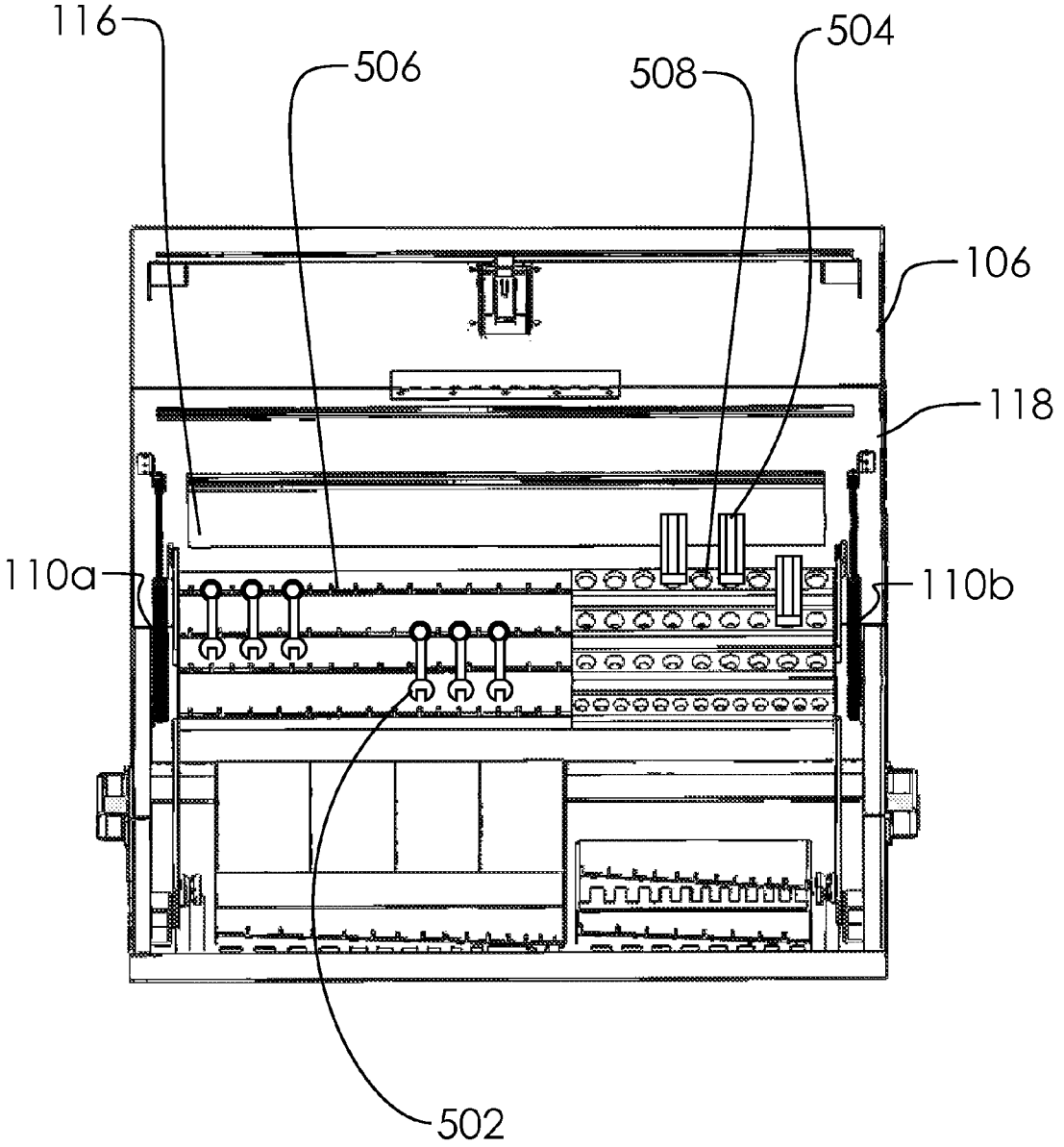
FIG. 5 illustrates an elevated front side view of said toolbox 100 in said expanded configuration 101 with a one or more tools.

FIG. 5 illustrates an elevated front side view of said toolbox 100 in said expanded configuration 101 with a one or more tools.

In one embodiment, said one or more tools can comprise a wrench 502, a screwdriver 504. In one embodiment, said pivoting rack 116 can comprise a one or more pegs 506 which can hold said wrench 502; and a one or more slots 508 which can hold said screwdriver 504.

In one embodiment, said first support 110*a* and said second support 110*b* can support said faceplate 106 and said lid 104 when said toolbox 100 is in said expanded configuration 101 and/or said closed configuration 300. In one embodiment, said first side first side 108*a* and said second side 108*b* can comprise pneumatic cylinders.

Figure 6:
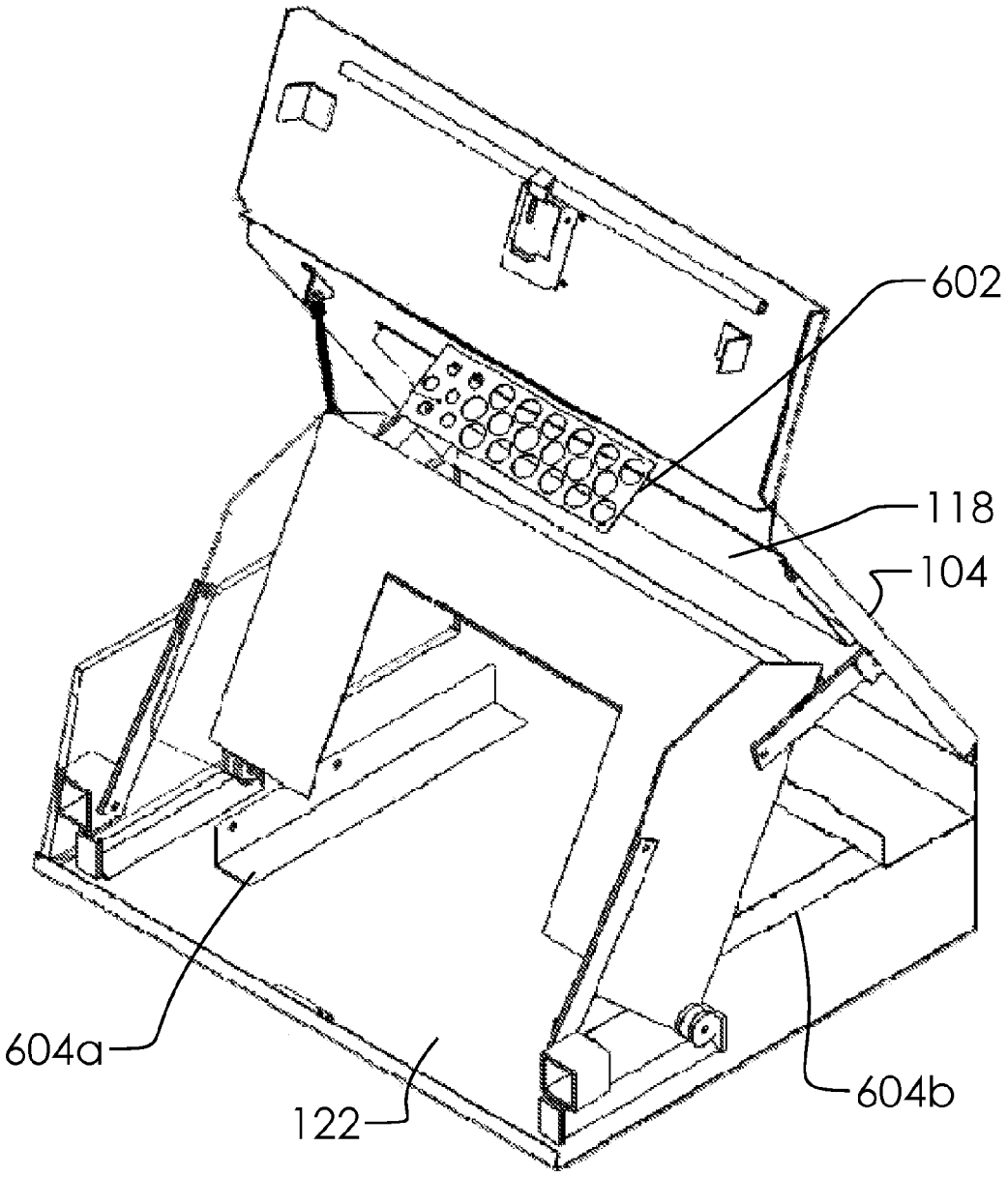
FIG. 6 illustrates an elevated second side overview of said toolbox 100 in an expanded configuration 101 being partially disassembled without said second side 108*b* and with said drawer 114 removed.

FIG. 6 illustrates an elevated second side overview of said toolbox 100 in an expanded configuration 101 being partially disassembled without said second side 108*b* and with said drawer 114 removed.

In one embodiment, said lid 104 can comprise a one or more tool slots 602, capable of holding one or more tools such as said screwdriver 504. In one embodiment, said bottom plate 122 of said toolbox 100 can comprise a one or more tracks which can comprise a first track 604*a* and a second track 604*b*. In one embodiment, said one or more tracks can be arranged as perpendicular with said faceplate 106 with said toolbox 100 in said closed configuration 300. In one embodiment, said drawer 114 can ride on said one or more tracks, as is known in the art.

Figure 7:
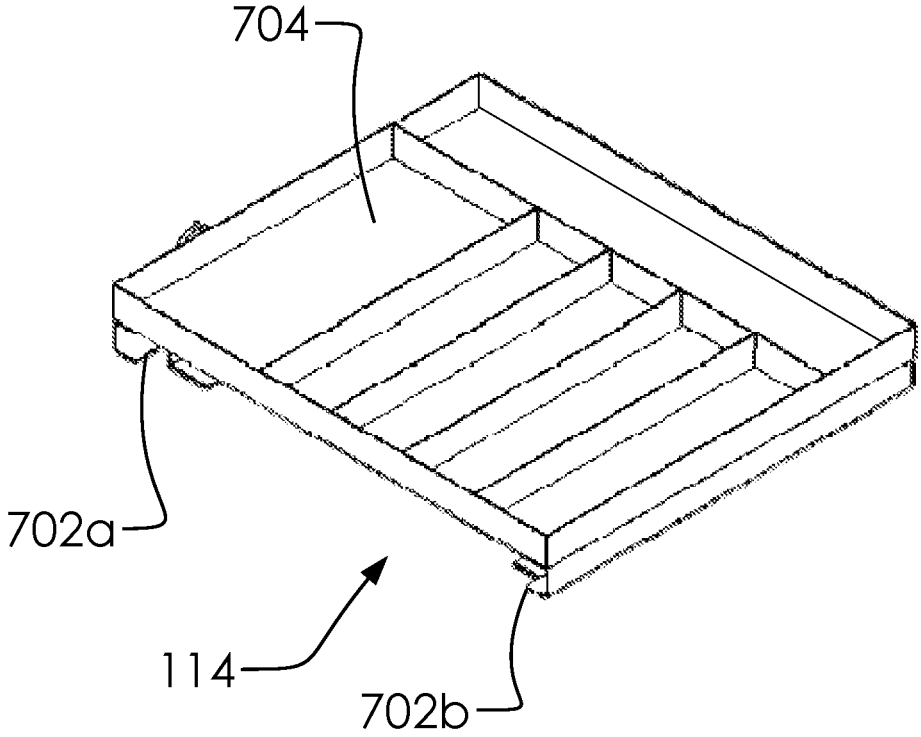
FIG. 7 illustrates an elevated second side overview of said drawer 114.

FIG. 7 illustrates an elevated second side overview of said drawer 114.

In one embodiment, said drawer 114 can comprise a one or more runners which can comprise a first runner 702*a* and a second runner 702*b*. In one embodiment, said one or more runners can releaseably attach to said one or more tracks; wherein, said drawer 114 can move relative to said bottom plate 122 on said one or more tracks. In one embodiment, said one or more runners can comprise bearings, wheels, or a friction surface allowing said drawer 114 to slide there along. In one embodiment, said drawer 114 can comprise a one or more compartments, such as a compartment 704.

Figure 8A:
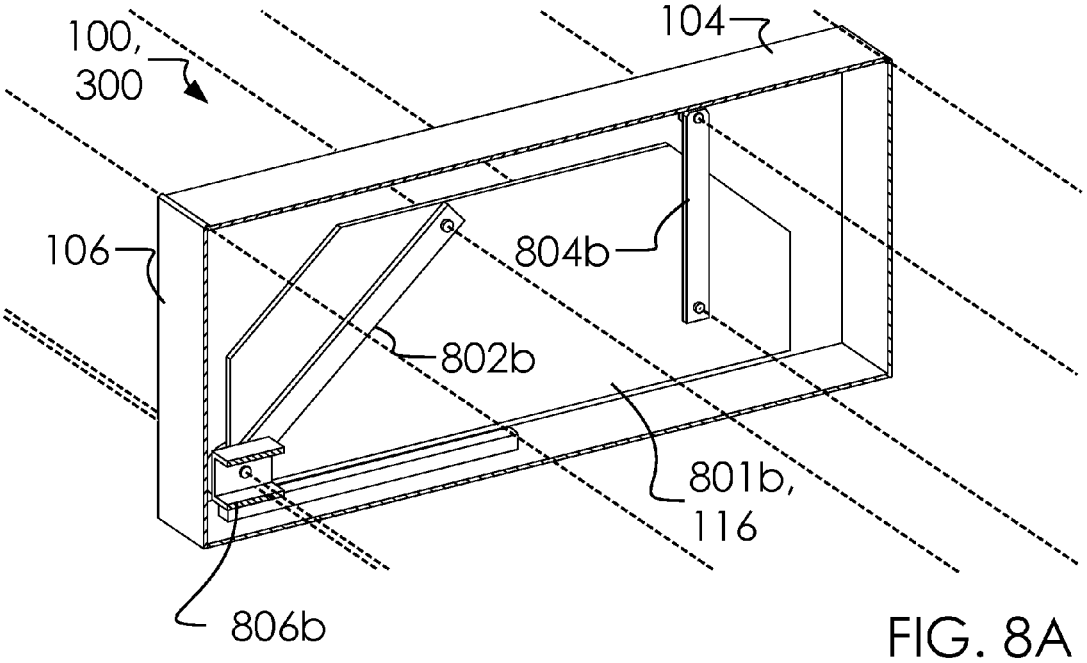
FIGS. 8A and 8B illustrate an elevated first side cross-section view of said toolbox 100 in said closed configuration 300, first as a perspective overview and then as an elevated side view, respectively.
Figure 8B:
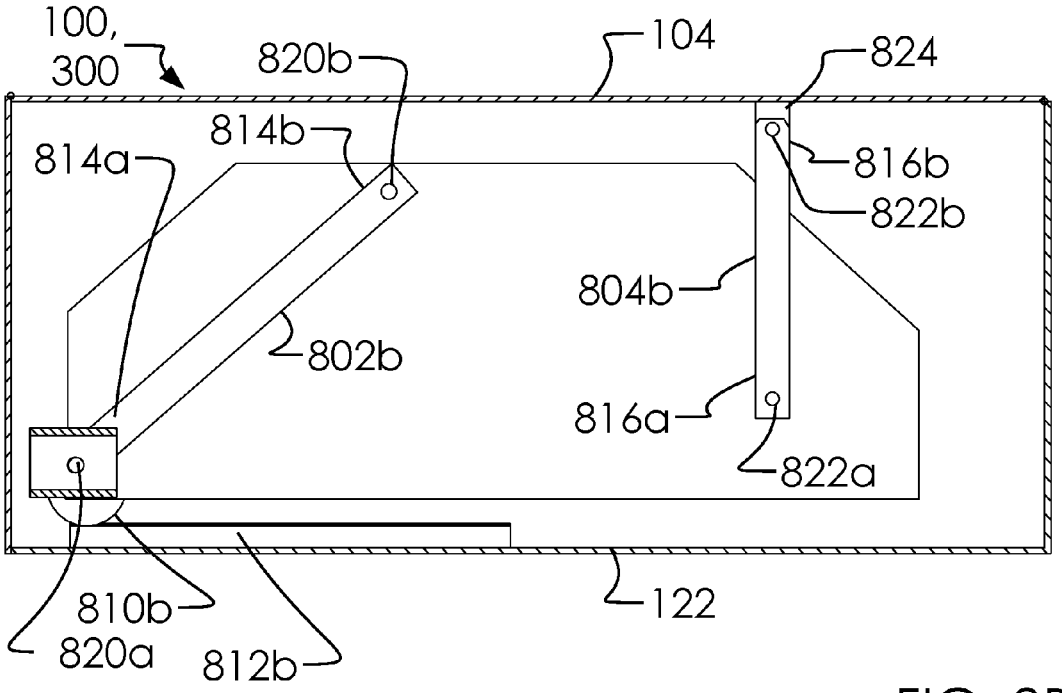
Figure 9A:
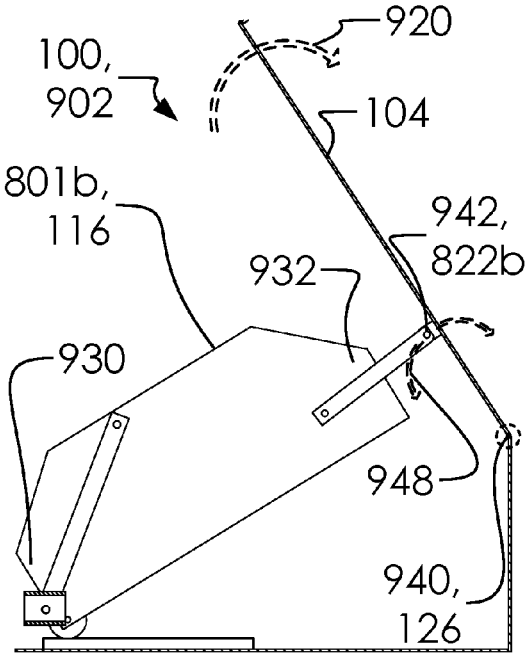
FIGS. 9A, 9B, 9C and 9D illustrate for annotated versions of an elevated first side cross-section view of said toolbox 100 in said a first position 902.
Figure 9B:
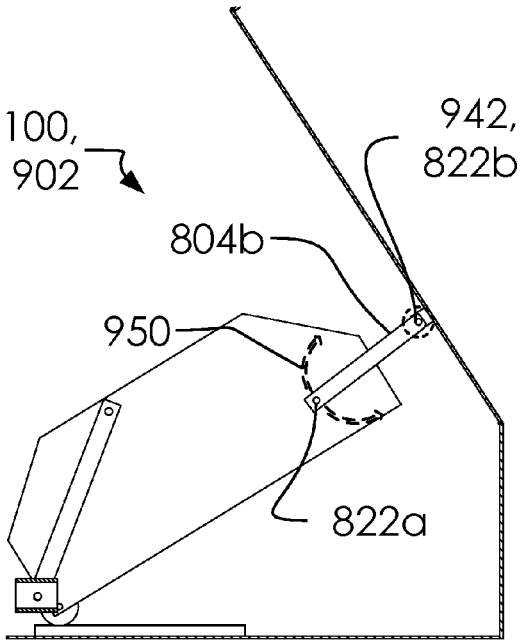
Figure 9C:
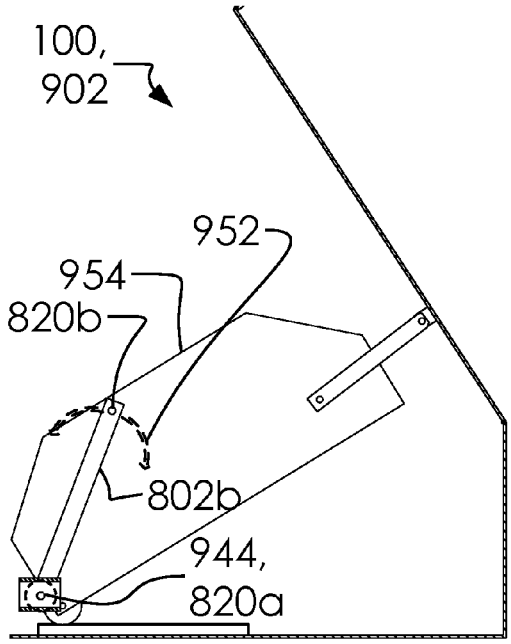
Figure 9D:
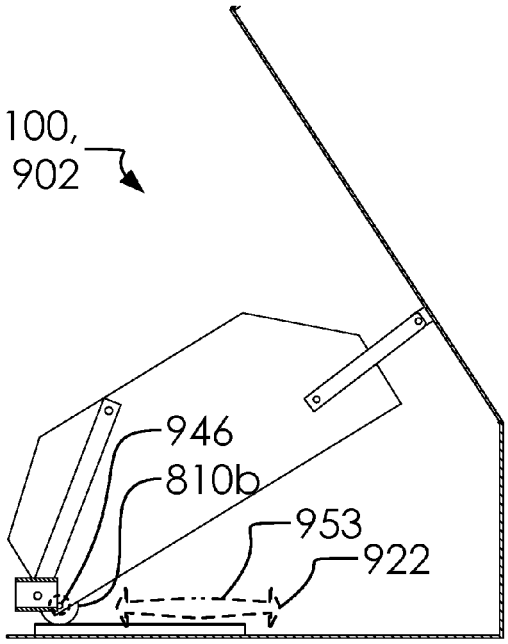

FIGS. 8A and 8B illustrate an elevated first side cross-section view of said toolbox 100 in said closed configuration 300, first as a perspective overview and then as an elevated side view, respectively.

In one embodiment, said pivoting rack 116 can comprise a first side portion 801*a* (not illustrated) and a second side portion 801*b*. In one embodiment, said second side portion 801*b* can comprise a substantially vertical planar surface attached to said body 102 with a second front arm 802*b* and said lid 104 with a second rear arm 804*b*, as discussed to follow. Likewise, said first side portion 801*a* can be attached to said lid 104 with a first rear arm 804*a* and said body 102 with a first front arm 802*a* (not illustrated). As disclosed, "first" rear and front arms are located on said first side and "second" rear and front arms are on said second side of said toolbox. In one embodiment, a two front arms can comprise said first front arm 802*a* and said second front arm 802*b*, and a two rear arms can comprise said first rear arm 804*a* and said second rear arm 804*b*.

In one embodiment, said toolbox 100 can further comprise a two outer brackets which can comprise a first outer bracket 806*a* (not illustrated) and a second outer bracket 806*b*. In one embodiment, said two outer brackets can attach to said pivoting rack 116 to said first side 108*a* and said second side 108*b*.

In one embodiment, said first front arm 802*b* can comprise a first end 814*a* and a second end 814*b*. In one embodiment, said first end 814*a* can rotateably attach to said second outer bracket 806*b* with a first hinge 820*a*. In one embodiment, said second end 814*b* can rotateably attach to said second side portion 801*b* with a second hinge 820*b*. In one embodiment, said second rear arm 804*b* can comprise a first end 816*a* and a second end 816*b*. In one embodiment, said first end 816*a* can rotateably attach to said second side portion 801*b* with a third hinge 822*a*. In one embodiment, said lid 104 can comprise a lid support 824, which can comprise a substantially vertical element suspended from and attached to said lid 104 being substantially parallel with said second rear arm 804*b*. In one embodiment, said second end 816*b* can rotateably attach to said lid support 824 of said lid 104 with a fourth hinge 822*b*.

In one embodiment, said pivoting rack 116 can move horizontally on a one or more tracks on said bottom plate 122, which can comprise a first track 812*a* (not illustrated) and a second track 812*b*. In one embodiment, said one or more track can comprise two tracks (said first track 812*a* and said second track 812*b*). In one embodiment, said pivoting rack 116 can comprise a one or more wheels, which can comprise a first wheel 810*a* (not illustrated) and a second wheel 810*b*. In one embodiment, said first wheel 810*a* can roll on said first track 812*a*, and said second wheel 810*b* can roll on said second track 812*b*. In one embodiment, said first wheel 810*a* and said second wheel 810*b* can roll on said one or more tracks, as illustrated and as is known in the art.

FIGS. 9A, 9B, 9C and 9D illustrate for annotated versions of an elevated first side cross-section view of said toolbox 100 in said a first position 902.

In one embodiment, said first position 902 and a second position 904 (not illustrated here) can comprise two configurations of said toolbox 100 in transition from said closed configuration 300 to said expanded configuration 101.

In one embodiment, said pivoting rack 116 can move according to a four axes comprising a first axis 940, a second axis 942, a third axis 944 a fourth axis 946. In one embodiment, said first axis 940 can comprise said first hinge 126 and can comprise an axis about which said fourth hinge 822*b* rotates. Thus, by lifting said lid 104 in said upward direction 920, said fourth hinge 822*b* can rotate about said first axis 940 in a first path 948.

In one embodiment, said second axis 942 can comprise said fourth hinge 822*b* and can comprise an axis about which said third hinge 822*a* rotates. Thus, when said fourth hinge 822*b* is moved by lifting said lid 104 with said upward direction 920, said third hinge 822*a* can be moved through a second path 950, as illustrated. Thus, said second rear arm 804*b* can rotate like a lever around said second axis 942, as illustrated.

In one embodiment, said third axis 944 can comprise said first hinge 820*a* and can be fixed to said body 102. In one embodiment, said first front arm 802*b* can rotate around said third axis 944 as a lever. In one embodiment, said second hinge 820*b* can rotate at the far end of said first front arm 802*b*. Accordingly, since said second side portion 801*b* is attached to said second hinge 820*b*, a top surface 954 said front side 930 can be shifted according to a third path 952.

In one embodiment, said fourth axis 946 can comprise a center axis of said second wheel 810*b*; wherein, said first wheel 810*a* and said second wheel 810*b* move in a fourth path 953, which can comprise a forward and a backward direction 922.

Figure 10:
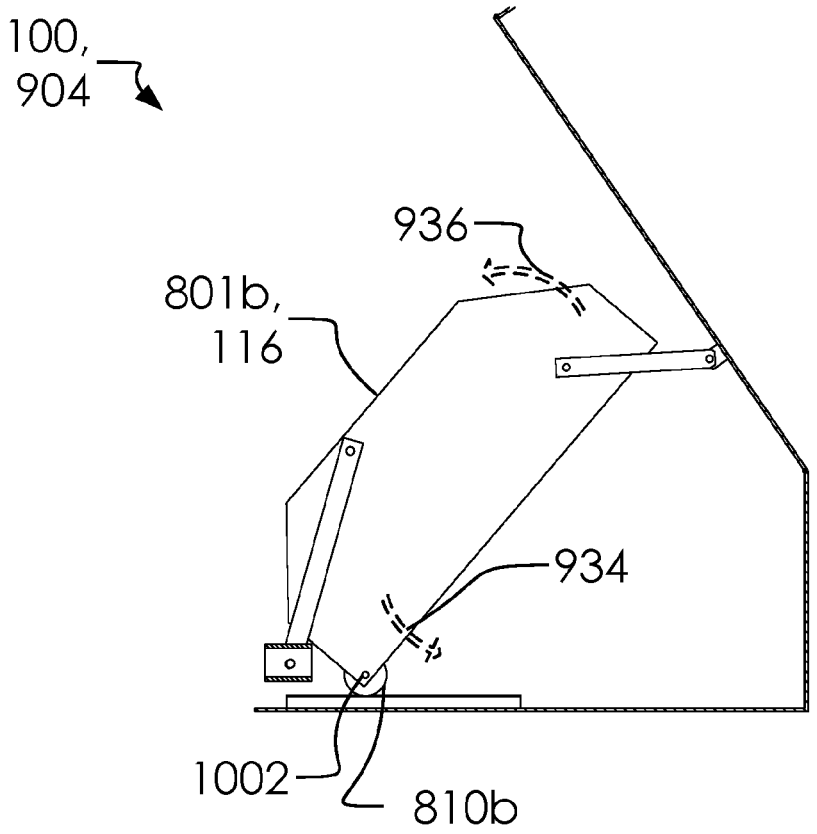
FIG. 10 illustrates an elevated front view said toolbox 100 in said second position 904.

FIG. 10 illustrates an elevated front view said toolbox 100 in said second position 904.

In one embodiment, transitioning said toolbox 100 from said closed configuration 300 to said expanded configuration 101 can comprise: opening said lid 104 in an upward direction 920; pulling said one or more wheels in said backward direction 922; rotating a front side 930 of said pivoting rack 116 in a down and back direction 934; rotating a back side 932 of said pivoting rack 116 in an up and forward direction 936. Said pivoting rack 116 comprises a bottom corner 1002. Said first side wheel 810*a* and said second side wheel 810*b* can be attached to said bottom corner 1002 of said pivoting rack 116.

Figure 11:
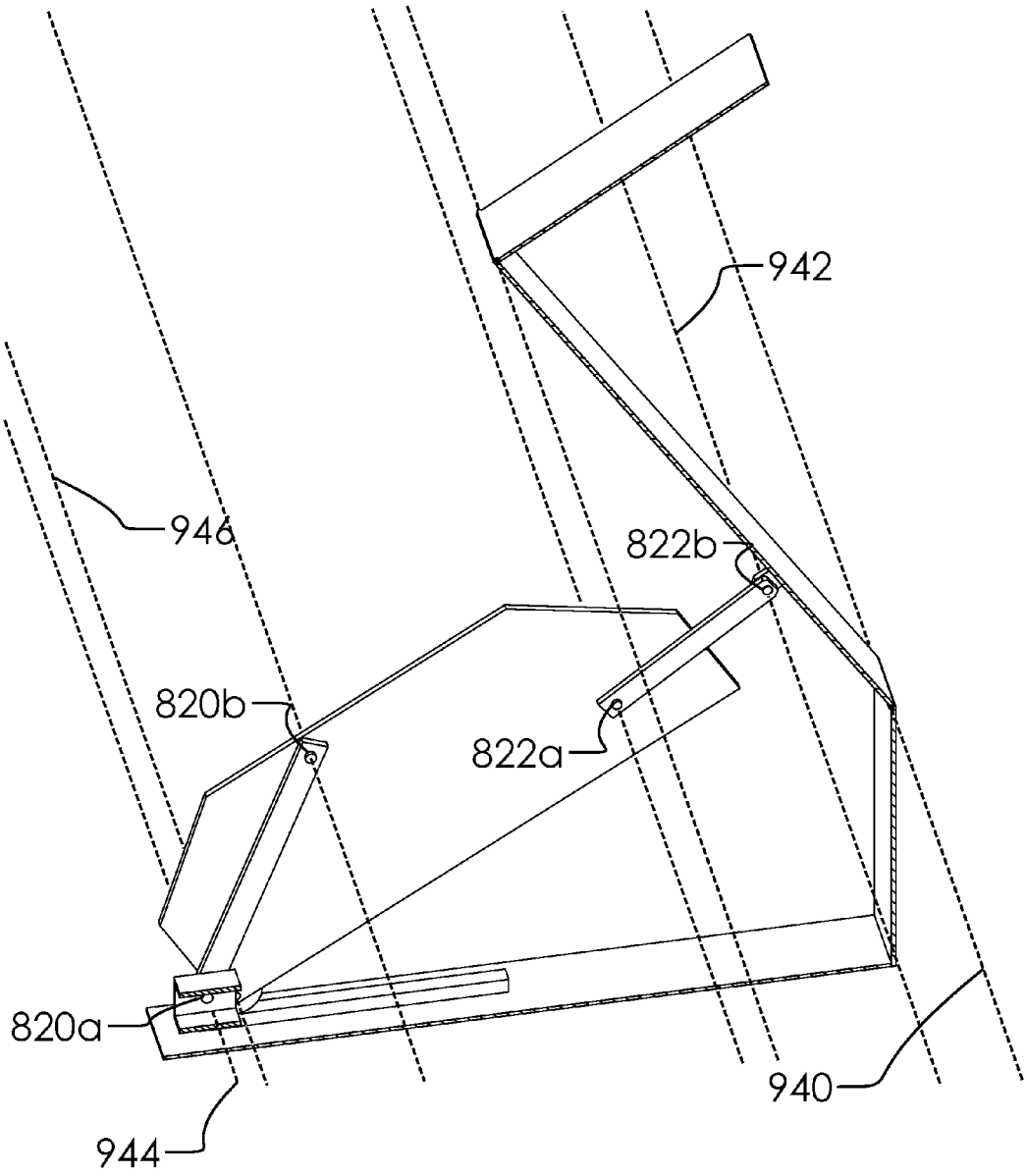
FIG. 11 illustrates a perspective overview of said toolbox 100 in said second position 904.

FIG. 11 illustrates a perspective overview of said toolbox 100 in said second position 904.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A toolbox comprising:

said toolbox comprises a body and a pivoting rack;

said body comprises a lid, a bottom plate, a faceplate, a back plate, a first side, a second side;

said toolbox is configured for selectively transitioning between an expanded configuration and a closed configuration;

said expanded configuration of said toolbox comprises an expanded height;

said body selectively opens and closes between said expanded configuration and said closed configuration;

with said toolbox in said closed configuration said body comprises a substantially rectangular shape and encases said tool box with said first side and said second side on it sides, said lid and a bottom plate at its top and bottom, and said faceplate and a back plate at its front and back sides;

said lid selectively rotates on said first hinge relative to said back plate;

a portion of said body wraps around said pivoting rack including said bottom plate below said pivoting rack, said lid, above said pivoting rack, said back plate behind said pivoting rack, said faceplate in front of said pivoting rack, and said sides on either side of said pivoting rack;

said bottom plate comprises a horizontal portion of said toolbox being attached to said sides and said back plate;

said back plate and sides are substantially perpendicular to said bottom plate and attached at three sides of said bottom plate;

said back plate is rotateably attached to said lid;

said faceplate is attached to said lid;

said toolbox further comprises a one or more tracks mounted to said bottom plate;

said pivoting rack comprises a one or more wheels configured to selectively roll on said one or more tracks and support a weight of said pivoting rack;

said pivoting rack comprises a first side and a second side;

said toolbox further comprises a two front arms and a two rear arms, wherein, said two front arms comprise a first front arm, a second front arm, said two rear arms comprise a first rear arm and a second rear arm, said first front arm and said first rear arm are rotateably attached to said first side of said pivoting rack, and said second front arm and said second rear arm are rotateably attached to said second side of said pivoting rack;

said two front arms each comprise a first end and a second end, wherein said first end of said two front arms each comprise a first hinge, and said second end of said two front arms each comprise a second hinge;

said two rear arms each comprise a first end and a second end;

said first end of said two rear arms each comprise a third hinge, and said second end of said two rear arms each comprise a fourth hinge;

said first hinge rotateably attaches said two front arms to said sides of said toolbox, wherein said two front arms rotate about said first hinge and remain attached to said sides of said toolbox;

said second hinge rotateably attaches said two front arms to said sides of said pivoting rack, wherein said pivoting rack and said two front arms selectively rotate relative to one another around said second hinge;

said third hinge rotateably attaches said two rear arms to said sides of said pivoting rack, wherein said two rear arms and said pivoting rack rotate relative to one another around said third hinge;

said fourth hinge rotateably attaches said two rear arms to said lid, wherein said two rear arms and said lid rotate relative to one another around said fourth hinge;

said pivoting rack selectively moves horizontally on said one or more wheels;

transitioning said toolbox from said closed configuration toward said expanded configuration causes said one or more wheels to roll back toward said back plate of said toolbox, and said third hinge to raise up relative to said bottom plate;

said one or more wheels support a portion of the weight of said pivoting rack without substantially stressing said two front arms and said two rear arms; and said tool box further comprises two supports comprising a first support and a second support; said two support each comprise a first end and a second end; said first ends of said two supports rotateably attach to said sides of said toolbox, wherein said first end of said first support is attached to said first side of said toolbox, and said first end of said second support is attached to said second side of said toolbox; and said second ends of said two supports rotateably attach to said lid of said toolbox; said two supports selectively hold said lid in an open position in said expanded configuration.

2. The toolbox of claim 1 further comprising:

said one or more tracks are arranged as perpendicular with said faceplate with said toolbox in said closed configuration.

3. The toolbox of claim 1 further comprising:

said body further comprises a one or more handles.

4. The toolbox of claim 1 further comprising:

said toolbox further comprises a lower tray.

5. The toolbox of claim 1 further comprising:

said toolbox further comprises a drawer.

6. The toolbox of claim 1 further comprising:

said toolbox comprises a latching system which comprises a latch and a strike plate; and further, said latching system comprises a locking mechanism.

7. The toolbox of claim 1 further comprising:

and said faceplate selectively rotates on a second hinge relative to said lid;

with said toolbox in said closed configuration said faceplate selectively rotates on said second hinge to provide access within said toolbox;

said closed configuration allows for access to tools within said toolbox; and said faceplate opens with said toolbox in said closed configuration which allows a drawer to be rolled out and accessed with said toolbox in a low profile.

8. The toolbox of claim 1 further comprising:

said pivoting rack comprises a one or more pegs and/or a one or more slots which are configured to selectively hold a one or more tools.

9. The toolbox of claim 1 further comprising:

said toolbox further comprises a drawer;

said drawer comprises a one or more runners;

said one or more runners releaseably attach to a one or more tracks within said body; and said drawer is configured to selectively move relative to said bottom plate on said one or more tracks.

10. The toolbox of claim 1 wherein:

said two front arms and said two rear arms comprise planar levers fixed between portions of said body and are configured to guide a movement path of said pivoting rack as between said closed configuration and said expanded configuration.

11. The toolbox of claim 1 wherein:

said toolbox further comprise a two brackets;

said two brackets attach to said sides of said body and comprise a first outer bracket and a second outer bracket;

said first outer bracket attaches to said first side of said body and said second outer bracket attaches to said second side of said body; and said first hinge of said two front arms attach to said two brackets in order to rotateably attach to said sides of said body, wherein said first outer bracket attaches to said first side of said body and said first end of said first front arm at said first hinge, and said second outer bracket attaches to said second side of said body and said first end of said second front arm at said first hinge.

12. The toolbox of claim 1 wherein:

said pivoting rack comprises a front side and a back side;

said second hinge of said two front arms rotateably attach to said front side of said pivoting rack;

said one or more wheels are attached to a bottom corner of said pivoting rack on said front side of said pivoting rack said third hinge of said two rear arms rotateably attach to said back side of said pivoting rack; and with said pivoting rack in said expanded configuration, said front side is rolled back toward said back plate on said one or more wheels and said back side of said pivoting rack is elevated up toward said lid of said body.

* * * * *